US006022660A

United States Patent [19]

Uno

[11] Patent Number: 6,022,660

[45] Date of Patent: Feb. 8, 2000

[54] DEVELOPER, PROCESS CARTRIDGE AND ELECTROPHOTOGRAPHIC IMAGE FORMING APPARATUS THAT EMPLOYS THE DEVELOPER AND PROCESS CARTRIDGE

[75] Inventor: Mugijiroh Uno, Isehara, Japan

[73] Assignee: Ricoh Company, Ltd., Tokyo, Japan

[21] Appl. No.: 09/087,937

[22] Filed: Jun. 1, 1998

[30] Foreign Application Priority Data

May 30, 1997 [JP] Japan ..... 9-141663

[51] Int. Cl.[7] ..... G03G 9/097

[52] U.S. Cl. ..... 430/110; 399/350

[58] Field of Search ..... 430/106, 110, 430/111; 399/350

[56] References Cited

U.S. PATENT DOCUMENTS 5,176,979 1/1993 Eguchi et al. ..... 430/110

5,583,625 12/1996 Kondoh ..... 355/298

5,776,648 7/1998 Ikami et al. ..... 430/120

*Primary Examiner*—John Goodrow

*Attorney, Agent, or Firm*—Oblon, Spivak, McClelland, Maier & Neustadt, P.C.

[57] ABSTRACT

A developer, process cartridge and electrophotographic apparatus that includes the process cartridge and developer, which has as component parts, a main toner body, and an additive that enhances the fluidity of the main toner body. A mixing ratio of the additive to the main toner body, ensures that a contact charger, will not become contaminated, with excess additive that bypasses a cleaning device. While the additive ensures a proper fluidity of the main body of the toner, an excessive amount of additive, beyond a predetermined range, is avoided, so as to prevent the additive from contaminating the contact charger, thus enhancing the lifespan of the contact charger while maintaining image quality.

21 Claims, 4 Drawing Sheets

DEVELOPER, PROCESS CARTRIDGE AND ELECTROPHOTOGRAPHIC IMAGE FORMING APPARATUS THAT EMPLOYS THE DEVELOPER AND PROCESS CARTRIDGE

CROSS-REFERENCE TO RELATED APPLICATION

This application contains subject matter related to that disclosed in commonly owned, application Ser. No. 08/882,214 filed on Jun. 25, 1997 now U.S. Pat. No. 5,879,849 entitled "Developing Device Using One Component Developer", the contents of which is incorporated herein by reference.

BACKGROUND OF THE INVENTION

1. Field of the Invention

The present invention relates to a developer, a process cartridge and an electrophotographic apparatus such as a copier, a printer, or a facsimile apparatus that uses the developer and process cartridge.

2. Discussion of the Background

It is common practice in an electrophotographic apparatus to form a latent image electrostatically on an image carrier, e.g., photoconductive element, and then to develop the latent image with a developer, i.e., toner with an additive, to produce a corresponding toner image. The apparatus then transfers the toner image to a paper or other recording medium in a transferring operation. The paper then has the toner image fixed thereto by heat and pressure and then is driven out of the apparatus as a recorded sheet.

An electrophotographic apparatus of the type described above is practicable with one of two different charging methods, i.e., a corona charging method (non-contact charging method), and a contact charging method. The contact charging method is advantageous over the corona charger in that it produces a minimum of ozone during operation, and in that it is operable with a low voltage.

The contact charging method holds a charger in contact with the photoconductive element. However, the contact charging method is susceptible to providing poor performance (e.g. non-uniform charging) when the charger becomes dirty with residual developer. With the contact charging method, therefore, the residual toner on the photoconductive element is removed by a cleaning blade so as to prevent the charger from getting dirty. The architecture of conventional contact charging apparatuses is such that the reliability of the charger has an inherent lifetime, after which, the charger should be replaced as part of routine maintenance.

However, the present inventor has determined that the reliability of the contact charging apparatus is also effected by a ratio of additive to toner. This observation was made in light of an identification of a failure mechanism of the conventional apparatuses, evident by observed white spots on a recorded sheet. Moreover, the present inventor observed that with conventional devices, after the removing procedure is performed, a small amount of the residual toner, and a related amount of the additive passes between the cleaning blade and the photoconductive element. This additive becomes particularly troublesome if the mixing ratio of the additive to toner is large because the diameter of the additive is very small relative to the diameter of the main body of the toner. Common additives, such as silica, have a particle size of 0.01 $\mu$m to 0.05 $\mu$m, while the average diameter of the main body of the toner varies between 5 $\mu$m to 20 $\mu$m. The present inventor determined that conventional devices do not account for relatively large ratios of additive to toner as being a failure mechanism (limiting the lifespan) of the charging apparatus. Thus, it is the additive, which is added to promote the flow of toner in the developing process, attaches and accumulates on the charge brush (or other charger) and gives rise to non-uniform charging. As a consequence, the charge brush does not adequately charge the photoconductive element and thus an electric potential surface of the photoconductive element, falls short of the normal range (−750 volt) to the abnormal range (−1200 volts, for example). As a consequence, because the photoconductive element is not adequately charged, when the photoconductive element is illuminated with a laser device or other light source so as to form a latent image thereon, the latent image does not produce the desired low voltage i.e., less negative), such that the toner fails to attach to the photoconductive element and consequently, the ultimate image produced by the image recording device, includes white spots thereon.

According to the present inventor's observations of conventional apparatuses, an insufficient amount of additive will prevent the toner from flowing properly, and therefore inhibit the developing process, while too much additive, will limit the lifespan of the charging apparatus, owing to the smaller size additive not being adequately cleaned from the photoconductive element, and contaminating the charging device, therefore preventing the charging device from providing a uniform charge on a photoconductive element. Rather than concluding that the charging element has a limited lifetime, the present observation is that the lifetime is effected by the relative amount of additive to toner.

SUMMARY OF THE INVENTION

The present invention has been made in view of the above mentioned and other problems and it is an object of this invention to address and overcome these and other problems. Accordingly, a developer, a process cartridge and an electrophotographic apparatus are provided that set a preferred mixing ratio of additive to toner, so as to limit the rate of which additive attaches on the charge brush or other charger and causes an abnormal discharge at the fibers of the charge brush. A developer that includes toner and additive is a feature of the present invention, where the additive has a significantly smaller particle size than the toner. The ratio of additive to toner is held within a predetermined range, so that the amount of additive will not accumulate to an excessive degree on the charger, and will enable the use of cleaning devices to clean the charger so as to prevent the accumulation of additive thereon. By combining the charger with a fixed range of additive to toner in an image forming apparatus, the degree of white spots observed on a recording medium is kept to a minimum, for an extended lifetime of the charger. Furthermore, by adjusting a resistance of charge brush fibers to a predetermined level, damage caused by accumulated additive is minimized.

BRIEF DESCRIPTION OF THE DRAWINGS

A more complete appreciation of the present invention and many of the attendant advantages thereof will be readily obtained as the same becomes understood by reference to the following detailed description when considered in connection with the accompanying drawings, wherein.

DETAILED DESCRIPTION OF THE PREFERRED EMBODIMENTS

Figure 1:
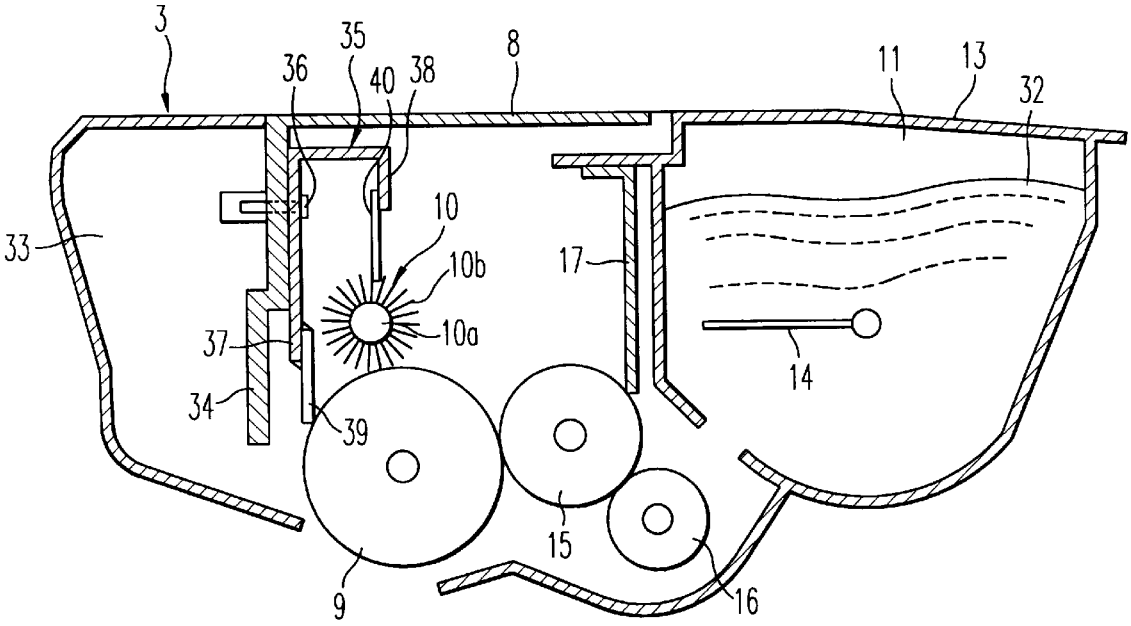
FIG. 1 is a side view of a process cartridge according to a first embodiment of the present invention.
Figure 2:
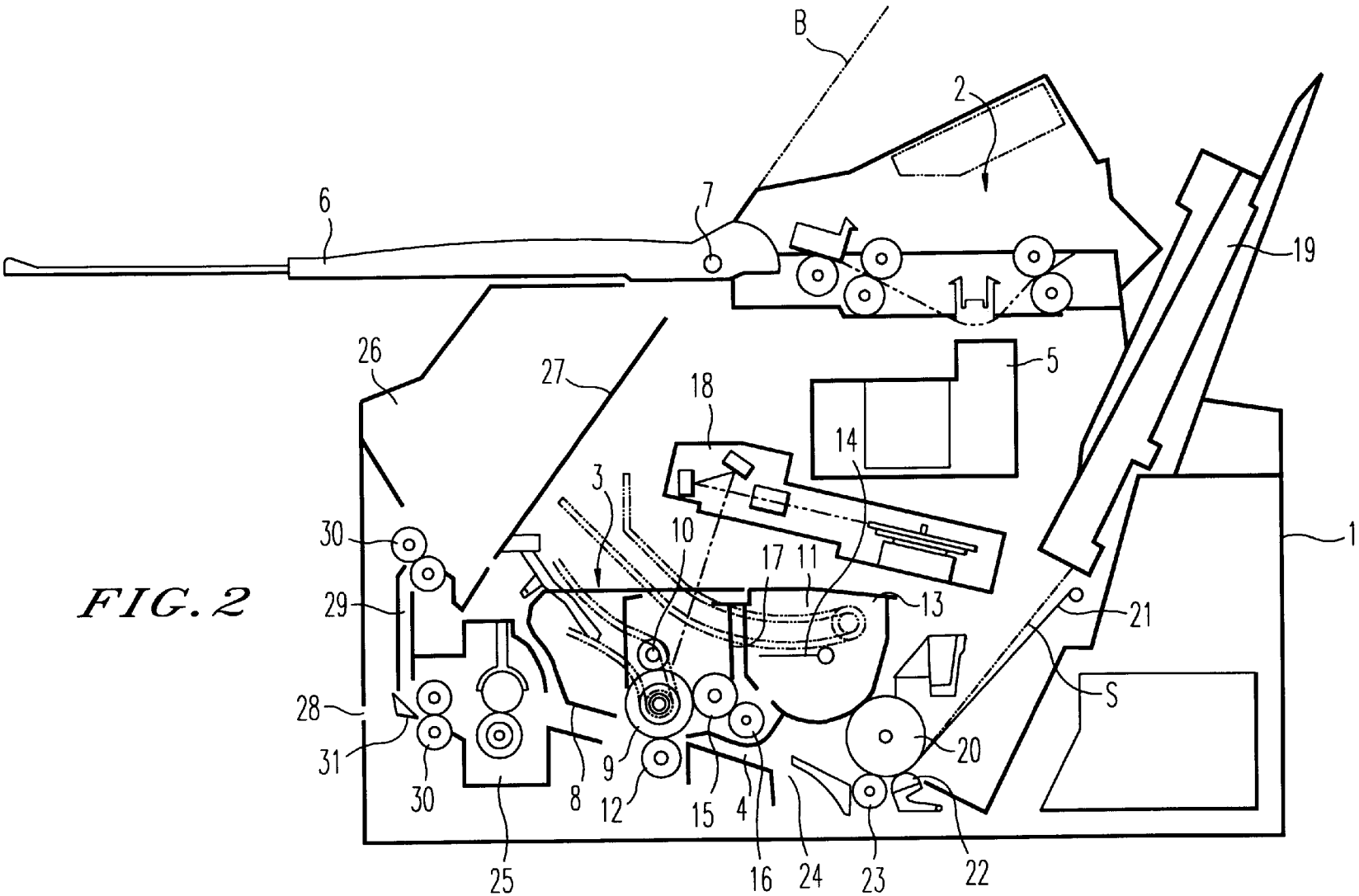
FIG. 2 is a side view of an electrophotographic apparatus according to the present invention.

Referring now to the drawings and FIGS. 1 and 2 in particular, FIG. 2 shows an electrophotographic apparatus 1, where the electrophotographic apparatus 1 is implemented with a two component developer and a process cartridge 3 embodying the present invention. As shown, the electrophotographic apparatus 1 has an image reading unit 2, a process cartridge 3, a paper feeding path 4, an image transfer roller 12, an image forming device 18, a paper supply tray 19, a paper supply roller 20, a pressure board 21, a separator (pad) 22, a pinch roller 23, a bottom path 24, a toner fixing device 25, an outlet paper tray 26, a discharging board 27, an outlet 28, a paper discharging path 29, an outlet roller pair 30 and an outlet selector 335, arranged as shown.

As shown in FIG. 1, the process cartridge 3 includes a casing 8, a photoconductive drum 9, a charge brush 10, a developer unit 11 having a fresh toner tank 13, an agitator 14, a developing roller 15, a toner supply roller 16, a roller blade 17, fresh toner 32, a waste toner tank 33, a compartment wall 34 on which an arm 35 is attached with a screw 36, a first support portion 37 and a second support portion 38 of the arm 35, where a cleaning blade 39 and a scraper 40 attach to the respective first and second support positions 37 and 38.

The waste toner tank 33 includes an opening near the cleaning blade 39 so that residual toner and additive remaining on the photoconductive drum 9 after an image forming operation are removed by the cleaning blade's scraping action and the residual toner and additive collect in the waste toner tank 33 by way of the opening. The fresh toner tank 13 stores the fresh toner 32 and the agitator 14 is rotated to force the fresh toner 32 out of the fresh toner supply tank 13 and toward the developer supply roller 16.

The charge brush 10 includes a conductive core 10*a*, which has a voltage applied thereto from a power supply, and a set of brush fibers 10*b* that cover the conductive core 10*a*. The brush fibers 10*b* are made of an electrically conductive fabric and a coating layer between a lining of the electric conductor fabric. The conductive core 10*a* is made of an electrically conductive material.

The developing roller 15, the paper supply roller 16 and the roller blade 17 are powered with a DC bias voltage from a bias power supply unit (not shown). The cleaning blade 39, which contacts the photoconductive drum 9, is fixed on the support portion 37 with a double-sided adhesive tape and hot-melt material, and the scraper 40 is fixed on the support portion 38 with double-sided adhesive tape. Alternatively, the cleaning blade 39 and/or the scraper 40 may be adjustably attached to the respective support positions 37 and 38 with a slide mechanism (e.g., a nut and bolt combination fitted in a slot).

As shown in FIG. 2, the image reading unit 2 includes an image scanner 5, such as a CCD (charge coupled device), a document tray 6 and a fulcrum 7. The document tray is movable to an "up" position (see dashed and dotted line B) and a "down" position, as shown, by way of the fulcrum 7. The image forming device 18 has an optics element that exposes the surface of the photoconductive drum 9 so as to electrostatically form a latent image thereon.

The operation of the image recording procedure is now described. The paper (or other image holding member, such as overhead projection sheets) stacked on the paper supply tray 19 are separated, one by one, by the paper supply roller 20, the pressure board 21 and the separator 22. At the same time the latent image on the photoconductive drum 9 is developed with toner (or other image forming substance) so as to form a toner (visible) image. Meanwhile, the separated paper sheets are fed through the bottom path 24 by the paper supply roller 20 and the pinch roller 23 to contact the photoconductive drum 9 that has the toner image thereon. The toner image is transferred to the paper sheet by way of the transfer roller 12 and subsequently fixed on the paper sheet by passing the paper sheet through the toner fixing device 25. After fixing, the paper sheet is discharged to the outlet 28, or the discharge board 27, as selected by the outlet selector 31.

The operation of the charging aspect of the image forming procedure will now be described. As shown in FIG. 1, an electric discharge occurs between the brush fabric 10*b* and surface of the photoconductive drum 9 just before the charge brush 10 contacts the photoconductive drum 9 or just after the charge brush 10 leaves the photoconductive drum 9 as long as the charge brush 10 has a sufficiently high voltage applied from the power supply unit. The photoconductive drum 9 is charged by this electric discharge. The charge brush 10 may, but need not, rotate while the photoconductive drum 9 is being charged. After charging, the optics of the image forming device 18 exposes the charged surface of the photoconductive drum 9 so as to form the latent image. The latent image is then developed and transferred.

After transferring the image to the paper sheet, a small amount of developer (i.e., residual toner and additive), which has not been transferred to the paper, remains on the photoconductive drum 9. The residual developer is removed by the cleaning blade 39, but some slips by the cleaning blade 39, especially the additive due to its relatively small size and the mechanical clearances and dynamics of the photoconductive drum 9 rotating past the cleaning blade 39.

First Embodiment

The image forming substance includes a main body of the toner 32 and an additive (such as silica or zinc-sterate), which has a volume average diameter 0.01 $\mu$m to 0.05 $\mu$m. The main body is made of a resin, a polarity controlling agent and a coloring agent, and has a volume average diameter 5 $\mu$m to 20 $\mu$m. The polarity controlling agent is for charging the toner 32 to a negative voltage, and the additive is an accelerator for easing the transfer of the main body during an image transfer operation.

In light of the present inventor's identification of the mechanism by which the reliability of charging device becomes reduced with time, the present inventor performed a series of experiments to determine a range of mixing ratios that may appropriately allow for an adequate toner flow, while not contaminating the charging brush to a significant degree. To this end, a metric for determining an acceptable range was determined to be a measured amount of white spots observed on an image formed in the electrophotographic process, so that a suitable range of mixing ratio between the toner and additive may be identified.

Figure 3:
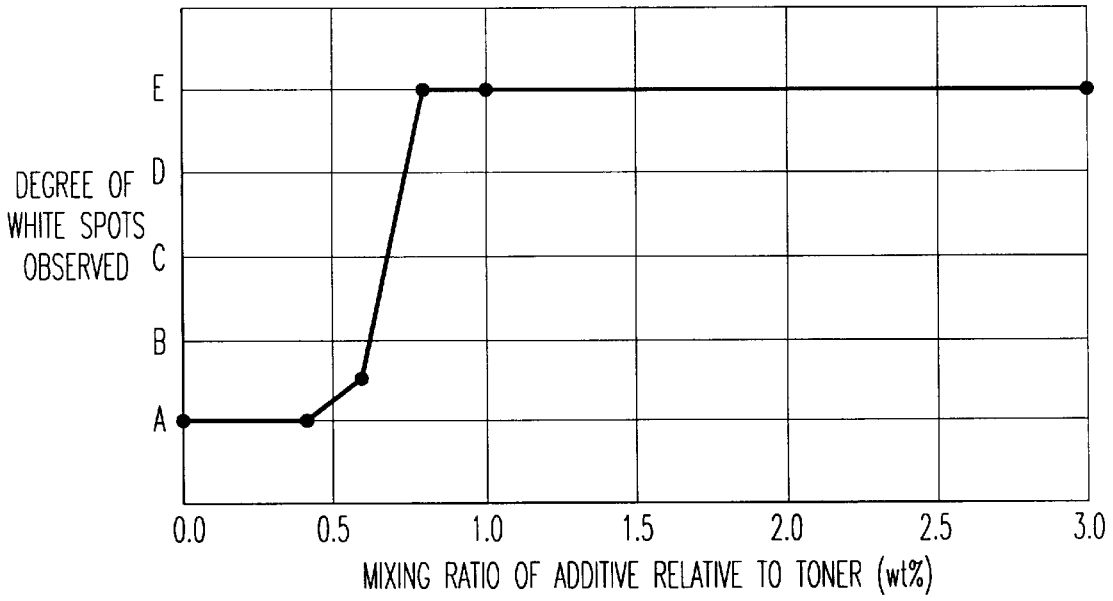
FIG. 3 is a graph showing an evaluation result of observed white spot occurring degree corresponding to the quantity of the additive particles relative to toner.

FIG. 3 is a graph showing an experimental result of the relationship between the observed white spots and the mixing ratio of the additive to toner (main body). The degree of white spot occurrence is divided into five classes (AGE), where the degree of observed white spots increases in alphabetical order (i.e., more whites spots are observed for "E" than for "A"). According to the data presented in FIG. 3, the white spot occurring degree increases suddenly, and surprising, if the mixing ratio of the additive is over 0.6 weight-%; such a pronounced change has not previously been appreciated. Accordingly, the empirical evidence indicates the surprising superior, and pronounced results indicated for classes A or B for providing superior image quality, at ratios of 0.6% or less.

According to the present invention, therefore, the mixing ratio of the additive was made to be from 0.1 to 0.6 weight-% of the toner 32, and the best mixing ratio was measured as being 0.4 weight-%.

Suitable components useful as the main toner body include the following, non-exhaustive, list of compounds: styrene polymers and derivatives thereof such as polystyrene, poly-p-chlorostyrene, and polyvinyl toluene; styrene copolymers such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleic acid ester copolymers; polymethyl methacrylate resins; polybutyl methacrylate resins; polyvinyl chloride resins; polyvinyl acetate resins; polyethylene resins; polypropylene resins; polyurethane resins; polyamide resins; epoxy resins; polyvinyl butyral resins; polyacrylate resins; rosins; modified rosins; terpene resins; aliphatic or alicyclic resins; aromatic petroleum resins; chlorinated paraffin waxes; and paraffin waxes. These compounds may be used alone or in combination.

Second Embodiment

As shown in FIG. 1, the process cartridge has the scraper 40 that contacts the charge brush 10. The charge brush 10 rotates clockwise so that the attached additive, or main body of the toner itself, is scraped off by the scraper 40. The present embodiment incorporates the scraper 10 because some amount of additive (and perhaps main body of the toner) was not removed by the cleaning blade 39 at the conclusion of the last image forming operation. The scraping action of scraper 40 helps to remove the remaining additive attached to the charge brush 10, and as a consequence further prolongs the useful lifetime of the charging brush 10 by scraping the accumulated additive therefrom. By cleaning the charging brush in this way, the situation is avoided where the accumulated additive insulates respective bristles from the photoconductive surface, and eliminates an electrical discharge thereto. Furthermore, by cleaning the charging brush 10 in a uniform manner, an uneven accumulation of additive on the charge brush 10 is avoided, and thus reduces the possibility of uneven charging on the drum 9.

Third Embodiment

In the third embodiment, the scraper 40 has a release layer formed thereon at a contacting point with the charge brush 10. The release layer helps to prevent the attachment of the additive, or the toner main body itself, on the scraper 40. The release layer may be, for example, a fluorine-containing resin applied to the scraper 40 as a film or by way of a fluorine-containing material applied as a prefabricated film (e.g., an adhesive tape, which is easily replaced in maintenance actions).

Fourth Embodiment

Figure 4:
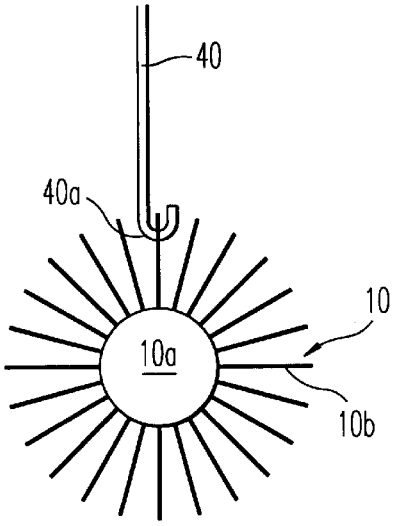
FIG. 4 shows a charge brush and a scraper according to a second embodiment of the present invention.

As shown in FIG. 4, a tip of the scraper 40 is formed with a curved surface 40*a*, so that the curved surface 40*a* prevents the brush fiber 10*b* from becoming sharpened, shortened or frayed when the bristles contact the scraper. If the bristles are damaged in this way, an abnormal discharging (i.e., inconsistent discharge from respective bristles) occurs from the damaged portions of the respective brush fibers 10*b*. By adding the curved surface 40*a*, the bristles, that come in contact with the scraper 40, do not hit a sharp edge, and therefore are not "sharpened" as would be the case with a sharper edged surface. Accordingly, a uniform charging is maintained for many printing operations.

Fifth Embodiment

Figure 7:
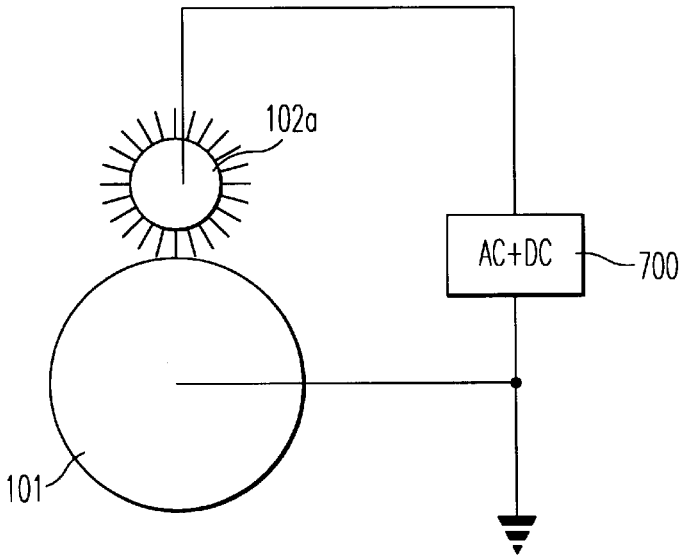
FIG. 7 shows a charge brush, and an AC plus DC power supply for providing a biased AC voltage to the charging device according to the present invention.

According to the fifth embodiment of the present invention, the charge brush 10 has applied thereto an AC voltage superimposed on a DC voltage from the power supply (see, e.g., FIG. 7). In FIG. 7, a DC biased AC voltage power supply 700 applies the voltage to the charge roller 102*a* as shown, for charging the drum 101.

Therefore, stray floating toner (main body particles) and additive particles around the photoconductive drum 9 are attracted toward the photoconductive drum 9 due to an electrostatic effect because the charged electric potential of the toner and additive are attracted by the AC voltage.

Furthermore, the charge brush 102*a* vibrates as a result of having the AC voltage applied thereto. Consequently, the attached toner or additive on the charge brush 10 falls down to the photoconductive drum 9 when the charge brush 10 leaves the photoconductive drum 9, so that the attached toner or the additive particles can be collected. Therefore, the biased AC voltage helps to prevent abnormal discharging at the charge brush 10 by removing unwanted toner (main body) and additive.

When employed in the context of FIG. 1, the photoconductive drum 9 and charge brush 10 rotate in a clockwise direction and so the charge brush 10 (102*a* in FIG. 7) is vibrated by the applied AC voltage before the charge brush 10 contacts the photoconductive drum 9. The attached toner (main body) and/or the additive falls down to the surface of the photoconductive drum 9 as a result of the vibration, and then is transferred to the developing unit 11 by the rotating photoconductive drum 9 so as to be collected.

Sixth Embodiment

Related to the problem of nonuniform charging of the photoconductor, the present inventor identified that unless the resistance of the respective bristles on the charge rollers is set in a predetermined range, the bristles themselves may be more or less affected by the accumulation of additive and toner (main body) if the respective sizes of the brushes are not all uniform. Because some of the bristles will become damaged as a result of prolonged operation, they undoubtedly will be shortened. Thus, by controlling the resistance of the respective brushes, corona discharge from the respective bristles, whether short or long, and whether contaminated with accumulated additive, or not, will not result in premature corona discharge to the photoconductive drum.

Figure 5:
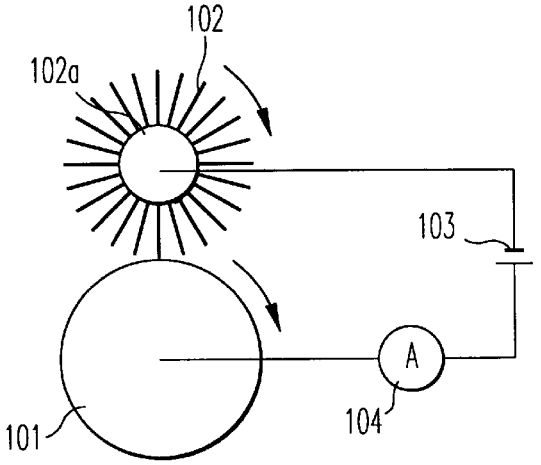
FIG. 5 shows a charge brush and a photoconductive drum according to a third embodiment of the present invention.

In order to quantify an acceptable range for the electrical resistance, based on this phenomenon, the present inventor conducted a series of experiments with an aluminum pipe 101 (see, e.g. FIG. 5) with charge brushes 102 of varying resistances. Each charge brush 102 was formed in a roll shape, and disposed to contact a peripheral surface of the aluminum pipe 101 with a 0.2 millimeters contact length. In each trial of the experiment, a different charge brush with different electrical resistance was used, and the results were observed. The electrical resistance of the respective charge brushes was calculated according to the following equation:

$$R(\text{ohm})=V/I/L \quad (1),$$

where

V=voltage supplied from the power supply, and

L=length of bristle section between the charge brush 102 and the pipe 101. In this case, a diameter of the aluminum pipe 101 was 24 millimeters and a diameter of the charge brush 102 was 14 millimeters. An electric current I was measured by the ammeter 104 so that Equation 1 could be solved.

Figure 6:
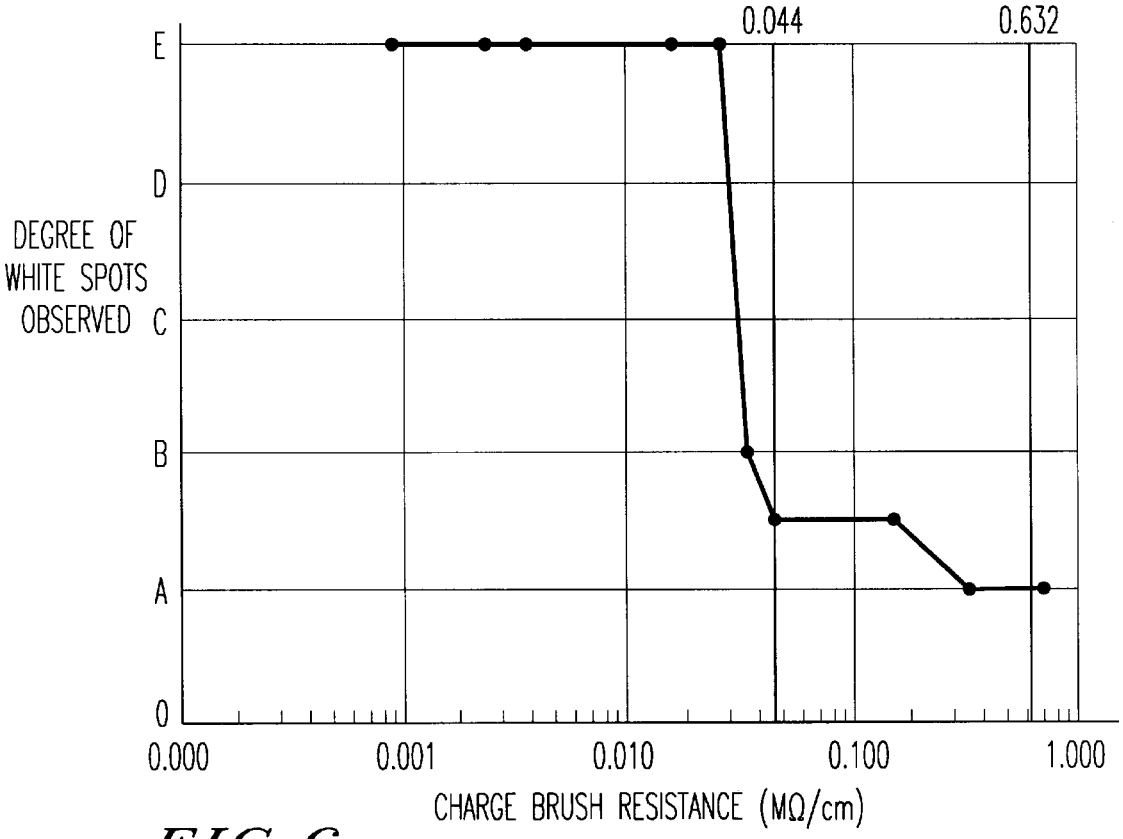
FIG. 6 is a graph showing an evaluation result of observed white spot occurring degree corresponding to the quantity of additive resident on a charge brush.

Results of the respective trials are shown in FIG. 6, where for each of the respective trials, the temperature was kept at 50 degrees and the humidity was kept at 50%. A mixing ratio of additive to toner was sent to be 0.8 weight-%, although a mixing ratio in the range of 0.1% to 0.6% could have been used as well. For the experiment, the conductive core 102*a* of the charge brush 102 was connected with a negative pole of the power supply 103, and the ammeter 104 was connected with the pipe 101 and a positive pole of the power supply 103. The charge brush 102 had applied thereto a −75 volt potential from the power supply 103. Further, the pipe 101 was rotated at 30 rotations per minute and the charge brush 102 was rotated at 75 rotations per minute in a same direction as the pipe 101.

FIG. 6 is a graph of the results from the experimental trials. In FIG. 6, the white spot occurring degree is divided into five classes (A~E) with "A" being minimal to no white spots. As observed, an electric resistance of 0.632 M-ohm/cm permits normal discharging and charging of the photoconductive drum 9. Below 0.632 M-ohm/cm, the performance is less certain and the degree of white spots observed increases. For example, below 0.044 M-ohm/cm, the number of white spots observed increases substantially and unexpectedly. The results also indicate the desirable class being A or B for obtaining high quality images on the recording paper, and the range of 0.044 to 0.632 Mega-ohm/cm providing minimal to no observed white spots.

While the above provides a full and complete disclosure of the preferred embodiments of the present invention, various modifications, alternate constructions and equivalents may be employed without departing from the true spirit and scope of the invention. Therefore, the above description and illustrations should not be construed as limiting the scope of the invention, which is defined by the appended claims.

Obviously, numerous modifications and variations of the present invention are possible in light of the above teachings. It is therefore to be understood that within the scope of the appended claims, the invention may be practiced otherwise than as specifically described herein.

The present document incorporates by reference the entire contents of Japanese priority document 09-141663, filed in Japan on May 30, 1997.

I claim:

1. A developer comprising:

a main body having, a resin component, a polarity controlling agent component, and a coloring agent component; and an additive mixed with said main body and being configured to promote a fluidity of said main body, wherein a relative weight percentage of said additive to a total weight, being in an inclusive range extending from above 0.5% through 0.6%, said total weight including a weight of said main body.

2. An image forming process cartridge comprising:

an image forming substance having, a main body having, a resin component, a polarity controlling agent component, and a coloring agent component, and an additive mixed with said main body and being configured to promote a fluidity of said main body, wherein a relative weight percentage of said additive to a total weight, being in an inclusive range of 0.1% to 0.6%, said total weight including a weight of said main body;

a photoconductive element having a surface;

a charger brush configured to uniformly charge the surface of said photoconductive element, said charger brush having bristles;

a developing device configured to hold said image forming substance therein and apply a portion of said image forming substance to said photoconductive element, so as to produce a developer image on said photoconductive element;

a cleaning blade positioned against the surface of the photoconductive element and configured to remove residual image forming substance from said photoconductive element, after said developer image is transferred from said photoconductive element to an image holding member; and a scraper having a contact portion disposed against the charger brush and configured to scrape off residual image forming substance collected on said charger brush.

3. The process cartridge of claim 2, wherein said scraper includes a release layer disposed on the contact portion of said scraper, said release layer configured to prevent said image forming substance from attaching to said scraper.

4. The process cartridge of claim 3, wherein:

said release layer includes fluoride-containing resin.

5. The process cartridge of claim 2, wherein said scraper includes a tip formed in a curved shape, said tip positioned to contact said charger brush.

6. The process cartridge of claim 2, further comprising:

a common support member configured to have said scraper and said cleaning blade connected thereto.

7. The process cartridge of claim 2, wherein said bristles of said charger roller have a resistance in an inclusive range of 0.044 Mega-ohm/cm to 0.632 Mega-ohm/cm.

8. The process cartridge of claim 2, further comprising a power supply that applies an alternating current voltage with a direct current voltage to the charging roller.

9. An image forming apparatus comprising:

an image forming substance having, a main body having, a resin component, a polarity controlling agent component, a coloring agent component, and an additive mixed with said main body and being configured to promote a fluidity of said main body, wherein a relative weight percentage of said additive to a total weight, being in an inclusive range of 0.1% to 0.6%, said total weight including a weight of said main body;

a photoconductive element having a surface;

a charger brush configured to uniformly charge the surface of said photoconductive element;

an image forming device, configured to form a latent image on the photoconductive element, after being charged with said charger brush;

a developing device configured to hold a supply of said image forming substance and apply a portion of said image forming substance on said photoconductive element so as to develop the latent image into a corresponding developer image;

an image transfer device configured to transfer the developer image from said photoconductive element to a transferring sheet; and a scraper having a contact portion disposed against the charger brush and configured to scrape off residual image forming substance collected on said charger brush.

10. The image forming apparatus of claim 9, wherein said scraper includes a release layer disposed on the contact portion of said scraper, said release layer configured to prevent said image forming substance from attaching to said scraper.

11. The image forming apparatus of claim 10, wherein:

said release layer includes fluoride-containing resin.

12. The image forming apparatus of claim 10, wherein said scraper includes a tip formed in a curved shape, said tip positioned to contact said charger brush.

13. The image forming apparatus of claim 9, further comprising:

a common support member configured to have said scraper and said cleaning blade connected thereto.

14. The image forming apparatus of claim 9, wherein said charger brush has bristles with a resistance in an inclusive range of 0.044 Mega-ohm/cm to 0.632 Mega-ohm/cm.

15. The image forming apparatus of claim 9, further comprising a power supply that applies an alternating current voltage with a direct current voltage to the charger brush.

16. An image forming apparatus comprising:

means for uniformly charging a photoconductive element including means for contacting a charger to the photoconductive element;

means for forming a latent image on the photoconductive element after said means for uniformly charging charges said photoconductive element;

means for developing the latent image with an image forming substance to produce a corresponding developer image;

means for transferring the developer image to a transfer member;

means for cleaning said means for charging; and means for preventing said image forming substance from accumulating on said means for charging, wherein said image forming substance includes a mixture of a main body and an additive, said additive configured to enhance a fluidity of said main body.

17. The image forming apparatus of claim 16, wherein said means for preventing comprises means for minimizing an occurrence rate of white spots on a transferred image that is transferred to the transferring sheet.

18. The image forming apparatus of claim 17, wherein said means for charging includes a charging roller having bristles.

19. The image forming apparatus of claim 18, wherein said bristles of said charging roller have a resistance in an inclusive range of 0.044 Mega-ohm/cm to 0.632 Mega-ohm/cm.

20. The image forming apparatus of claim 18, further comprising means for vibrating the charging roller so as to remove accumulated additive from the charging roller.

21. The image forming apparatus of claim 18, wherein said means for vibrating comprises means for applying an alternating current voltage with a direct current voltage to the charging roller.

* * * * *